United States Patent [19]

Tam et al.

[11] 4,246,448

[45] Jan. 20, 1981

[54] ELECTROMECHANICAL TRANSDUCER

[75] Inventors: Man C. Tam; Loh-Yi Chang, both of Guelph, Canada

[73] Assignee: Uniroyal Ltd., Guelph, Canada

[21] Appl. No.: 821,384

[22] Filed: Aug. 3, 1977

Related U.S. Application Data

[63] Continuation of Ser. No. 615,669, Sep. 22, 1975, abandoned.

[30] Foreign Application Priority Data

Jul. 8, 1975 [CA] Canada ..... 231048

[51] Int. Cl.[3] ..... H04R 19/00; B61F 17/00

[52] U.S. Cl. ..... 179/111 E; 179/111 R; 307/400

[58] Field of Search ..... 179/111 R, 111 E; 307/88 ET

[56] References Cited

U.S. PATENT DOCUMENTS

| | | | |
|---|---|---|---|
| 1,082,248 | 12/1913 | Unterholzner | 179/111 R |
| 3,821,492 | 6/1974 | Tamura et al. | 179/111 E |
| 3,941,946 | 3/1976 | Kawakami et al. | 179/111 R |
| 3,980,838 | 9/1976 | Yakushiji et al. | 179/111 E |

FOREIGN PATENT DOCUMENTS

| | | | |
|---|---|---|---|
| 838024 | 6/1960 | United Kingdom | 179/111 R |

*Primary Examiner*—Vincent P. Canney
*Attorney, Agent, or Firm*—Charles A. Blank

[57] ABSTRACT

An electromechanical electret transducer suitable for push-pull operation includes multiple vibratory diaphragms acoustically coupled to each other to increase the output sound pressure. Since the diaphragms physically shield the stationary electrets, the adverse environmental effects on the charge stabilities of the electrets are minimized.

7 Claims, 3 Drawing Figures

ELECTROMECHANICAL TRANSDUCER

This is a continuation of application Ser. No. 615,669, filed Sept. 22, 1975 now abandoned.

This invention relates to electromechanical transducers, and, more particularly, to electrostatic electroacoustic transducers of the type utilizing a plurality of stationary electrets in a construction suitable for push-pull operation without requiring an external direct-current bias voltage and including a plurality of vibratory diaphragms acoustically coupled to each other to increase the output sound pressure. Since these diaphragms also physically shield the electrets, the adverse environmental effects on the charge stabilities of the electrets are minimized.

A prior electrostatic transducer is described in U.S. Pat. No. 3,136,367-Brettell which requires an external active high direct-current bias voltage source and a center-tapped transformer. A plurality of vibratory diaphragms are mounted in a structure of stacked frames with perforated metal electrodes between the diaphragms. Direct-current bias voltage is applied to the diaphragms by connecting successive diaphragms to opposite terminals of a direct-current high voltage supply having a grounded center tap. The terminals of a center-tapped transformer are alternately connected to successive metal electrodes and the center tap is grounded. An improved sound power output is obtained as compared with a similar transducer having a single diaphragm, but the transducer has the disadvantage of requiring a high direct-current voltage supply and a center-tapped transformer, presenting a high voltage hazard, complicated design problems and additional cost.

An electrostatic headphone using a plurality of foil electrets as the vibratory diaphragms each, for example, 0.25 mil thick and held between two rigid perforated metal plates is described in U.S. Pat. No. 3,118,022-Sessler et al. Since foil electrets are capable of supplying only approximately 200 volts of equivalent direct-current bias voltage, this relatively low equivalent direct-current bias voltage imposes a severe limitation on the maximum input audio signal that can be applied, hence restricting sound output of the transducer. To avoid severe harmonic distortion, the maximum input audio signal voltage must at no time exceed the direct-current bias voltage. In the case of an electrostatic loudspeaker which requires an equivalent direct-current bias voltage of the order of kilovolts, foil electrets are totally inadequate. There is another great disadvantage in using the electrets as the vibratory diaphragms. In order to achieve a stable and specified performance of the transducer, it is necessary to control the diaphragm tension and to maintain a constant geometry. Since most known good polymeric electrets, for example, Teflon-FEP, have relatively poor mechanical properties and exhibit creep, i.e. continuous expansion under constant stress, it is thus extremely difficult to achieve constant diaphragm tension and stable performance using electrets as vibratory diaphragms.

A transducer of the prior art utilizing electrets is described in Canadian Pat. No. 908,281-Tamura et al. The transducer utilizes two rigid perforated metal electrodes, two perforated electrets, and a conductive thin vibratory diaphragm. The perforations on the metal electrodes and the electrets are substantially aligned to permit passage of acoustic radiation from the vibratory diaphragm which is positioned midway between the two electrets. The polarities of the electrical charges on the surfaces of the electrets facing the diaphragm are opposite in sign. The audio signal source is connected to the primary windings of the transformer. The two metal electrodes are connected to one terminal and the diaphragm to the other terminal of the secondary windings of the transformer. This transducer has the disadvantage of having only limited sound output capability, particularly in the low frequency range, because of the necessity of using a narrow spacing between the diaphragm and the electrets. Another disadvantage of this transducer is that the electrets are not protected from the adverse effects of outside environment such as humidity, ions and dust present in the atmosphere etc. It is well known that surface charges of even superior electrets, such as Teflon-FEP, decay more rapidly if exposed to humidity or ions present in the atmosphere. It is therefore difficult for the transducer to maintain a stable performance over long periods of time.

It is an object of the present invention, therefore, to provide a new and improved electromechanical transducer which avoids one or more disadvantages of such prior transducers.

It is another object of the invention to provide a new and improved transducer utilizing an electret construction and suitable for push-pull operation.

It is another object of the invention to provide a new and improved transducer utilizing an electret construction and suitable for push-pull operation and having improved sound power output capability.

It is another object of the invention to provide a new and improved transducer utilizing a simple electret construction and suitable for push-pull operation.

It is another object of the invention to provide a new and improved transducer utilizing an electret construction in which the electrets are stationary. This construction offers flexibility in selecting the appropriate materials to suit the requirement of mechanical properties of diaphragms and the requirement of electrical properties of electrets.

It is another object of the invention to provide a new and improved transducer utilizing an electret construction in which the electrets are physically shielded from the detrimental effects of outside environment on the surface charge stability of electrets. Thus the transducer can maintain stable performance over a long period of time.

It is another object of the invention to provide a new and improved transducer utilizing an electret construction in which the electrets are capable of supplying an equivalent direct-current bias voltage of several kilovolts. Thus higher input audio signal voltage can be applied to increase the output sound pressure without introducing objectionable harmonic distortion.

It is another object of the invention to provide a new and improved transducer utilizing an electret construction and suitable for push-pull operation as a loudspeaker or a headphone which achieve good fidelity. This transducer can also be used as a sound microphone or as an ultrasonic generator or receiver.

In accordance with the invention, an electromechanical transducer comprises a first pair of electrostatically polarized stator electrets, and conductive means adjacent each of the electrets, the electrets and the conductive means each having apertures therethrough. The transducer also includes first thin vibratory diaphragm means comprising a layer of conductive material, means for supporting the diaphragm means between the electrets in spaced relation thereto, the electrets being polarized to develop electrical charges of opposite polarity on the surfaces of the electrets facing the diaphragm means. The transducer also includes a second pair of electrostatically polarized stator electrets, one of the second pair of electrets being adjacent one of the first pair of conductive means. The transducer also includes third conductive means adjacent the other electret of the second pair. The second pair of electrets and the conductive means adjacent thereto each have apertures therethrough. The transducer also includes second thin vibratory diaphragm means comprising a layer of conductive material, and means for supporting the second diaphragm means between the second pair of electrets in spaced relation thereto. The second pair of electrets is polarized to develop electrical charges of opposite polarity on the surfaces of the second pair of electrets facing said second diaphragm means and the second pair of electrets also is polarized to develop electrical charges of the same polarity as corresponding electrets of the first pair develop on the surfaces thereof facing the first diaphragm means. The first and second diaphragm means are acoustically coupled.

Also in accordance with the invention, an electromechanical transducer comprises a pair of electrostatically polarized stator electrets, conductive means adjacent the electrets, the electrets and the conductive means each having apertures therethrough. The transducer also includes first and second thin vibratory diaphragm means each comprising a layer of conductive material, means for supporting the first diaphragm means in spaced relation to one of the electrets, and means for supporting the second diaphragm means in spaced relation to the other electret. The electrets and the conductive means are disposed between the first and second diaphragm means. The electrets are polarized to develop electrical charges of opposite polarity on the surface of the electrets facing the diaphragm means. The diaphragm means are acoustically coupled.

By stator electrets is meant electrets which are stationary within the transducer insofar as mechanical vibrations, for example, sound-reproducing vibrations are concerned.

As used herein, the term acoustically coupled is not limited to mean coupling at frequencies within the audible range but may refer to coupling at frequencies above the audible range for ultrasonic transducers.

For a better understanding of the present invention, together with other and further objects thereof, reference is made to the following description, taken in connection with the accompanying drawings, and its scope will be pointed out in the appended claims.

Referring now to the drawings.

For a better understanding of the present invention, together with other and further objects thereof, reference is made to the following description, taken in connection with the accompanying drawings, and its scope will be pointed out in the appended claims.

Figure 1:
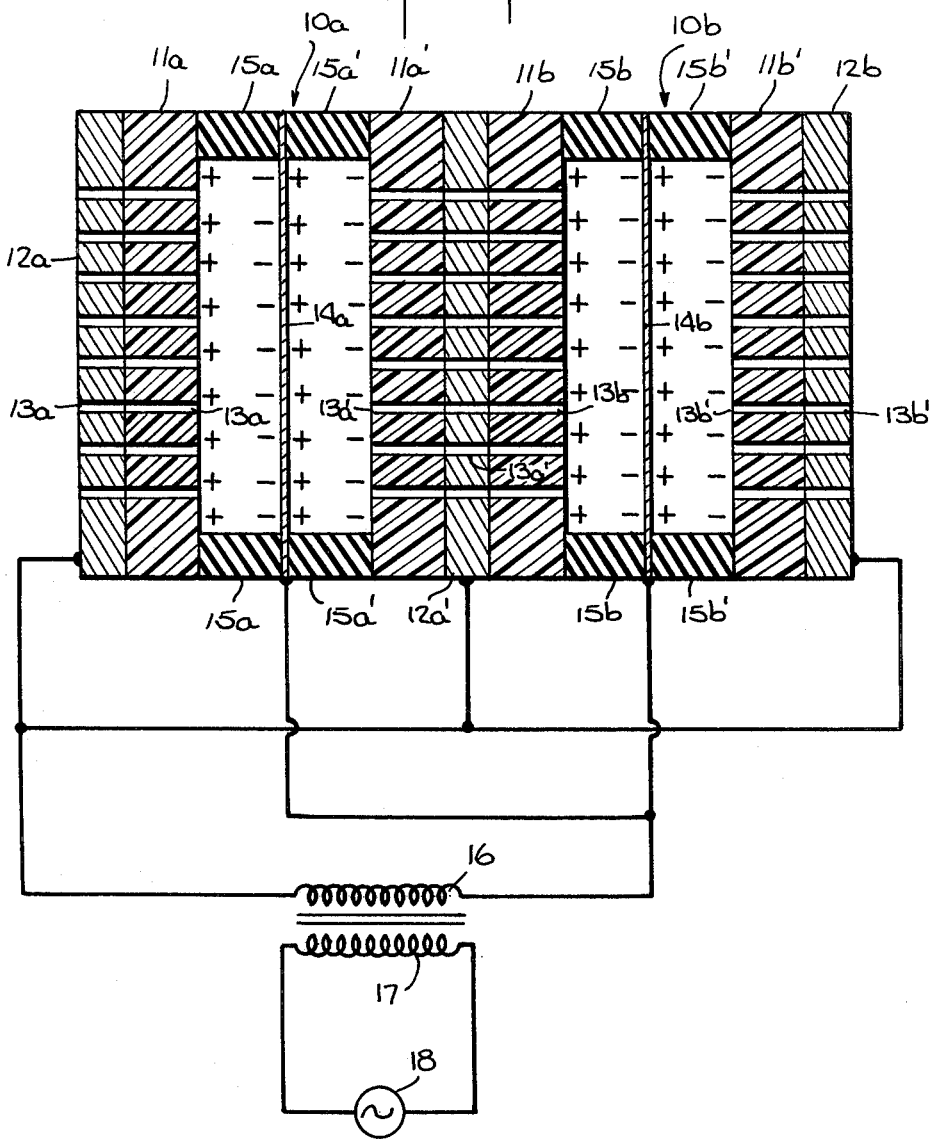
FIG. 1 is a schematic sectional view of a transducer constructed in accordance with the invention.

Referring now more particularly to FIG. 1 of the drawings, an electromechanical transducer in accordance with the invention preferably includes a plurality, for example, two, substantially identical sounding units 10*a* and 10*b* but having one electrode in common. The sounding unit 10*a* comprises a first pair of electrostatically polarized electrets 11*a*,11*a*'. The electrets 11*a*,11*a*' are sheet electrets each having a thickness preferably in the range of 5 mils to 100 mils, for example, 20 mils. The electrets 11*a*,11*a*' may be any dielectric material which is capable of storing electrical charges for a long period of time, for example, polychlorotrifluoroethylene available under the trademark Aclar of Allied Chemical Corporation or tetrafluoroethylene-hexafluoropropylene copolymer available under the trademark Teflon-FEP of E. I. du Pont de Nemours & Co. The surface charge density of each electret may be, for example, $5\times10^{-8}$ coulombs per square centimeter. The electrets may be charged by any known techniques such as corona discharge or scanning electron beam.

Each electret 11*a*,11*a*' has conductive means 12*a*,12*a*' adjacent thereto. The conductive means 12*a*,12*a*' preferably are rigid metal electrodes and may be, for example, aluminum plates of 20 mils thickness. The thickness of the electrodes is not critical. The electrets 11*a*,11*a*' and the conductive means 12*a*,12*a*' each have apertures 13*a*,13*a*' therethrough which may be provided by perforating the electrets and the adjacent electrodes in a desired pattern with the apertures of each electret and its adjacent electrode being substantially aligned. Each of the apertures preferably has a diameter in the range of 1/16 to ¼ inch, for example, 3/32 inch. The apertures preferably are uniformly distributed and the total area of the apertures may be 33 percent of the total area of each electret, as may be determined by the maximum sound transmission efficiency.

The sounding unit 10*a* also includes first thin vibratory diaphragm means 14*a* comprising a layer of conductive material. The diaphragm means preferably comprises a polyethylene terephthalate film, available under the trademark Mylar of E. I. du Pont de Nemours & Co., metallized on at least one side. The Mylar material of the diaphragm means preferably has a thickness in the range of ¼ to 2 mil and may be, for example, ½ mil thick.

The sounding unit 10*a* also includes means for supporting the diaphragm means 14*a* between the electrets 11*a*,11*a*' in spaced relation thereto throughout the dynamic operation of the diaphragm means 14*a* comprising, for example, suitable frames 15*a*,15*a*', for example, cardboard frames which are adhesively bonded to the diaphragm means 14*a* held in stretched condition thereon. Suitable electrical connections are provided for the diaphragm means 14*a*. The cardboard frames preferably have a thickness in the range of 0.005 inch to 0.25 inch and thus provide an air gap distance of a 0.005 inch to 0.25 inch between the diaphragm means and each electret 11*a*,11*a*'.

The electrets 11*a*,11*a*' are polarized to develop electrical charges of opposite polarity on the surfaces of the electrets facing the diaphragm means 14*a*, as represented schematically in FIG. 1.

The sounding unit 10*b* of the transducer includes a second pair of electrostatically polarized electrets 11*b*,11*b*' preferably having conductive means 12*a*',12*b* adjacent thereto. One of the second pair of electrets 11*b* is adjacent the conductive means 12*a*' between electrets 11*a*',11*b*.

The second pair of electrets 11b,11b' and the conductive means 12a',12b adjacent thereto have apertures 13b,13b' therethrough as represented in FIG. 1. The apertures 13b of the electret 11b adjacent the conductive means 12a' are preferably substantially aligned with the apertures 13a' of the adjacent electret 11a' and conductive means 12a'.

The second sounding unit 10b includes second thin vibratory diaphragm means 14b comprising a layer of conductive material and being similar to diaphragm means 14a. The second sounding unit 10b also includes means 15b,15b' for supporting the second diaphragm means 14b between the second pair of electrets 11b,11b' in spaced relation thereto throughout the dynamic operation of the second diaphragm means 14b. The second pair of electrets 11b,11b' is polarized to develop electrical charges of opposite polarity on the surfaces of the second pair of electrets facing the diaphragm means 14b, as represented diagrammatically in FIG. 1. The second pair of electrets 11b,11b' also is polarized to develop electrical charges of the same polarity as corresponding electrets 11a,11a' of the first pair develop on the sufaces thereof facing the first diaphragm means 14a.

The first and second diaphragm means 14a,14b are so acoustically coupled to each other through the aligned apertures 13a',13b as to vibrate in unison throughout the dynamic operation of the transducer.

The perforated metal electrodes 12a,12a', 12b, the electrets 11a,11a', 11b,11b', the diaphragm means 14a,14b, and the diaphragm-supporting means 15a,15a', 15b,15b' are assembled into the configuration shown schematically in FIG. 1. The whole assembly can be, for example, secured by plastic screws and supported in suitable housing units (not shown).

There is coupled to the FIG. 1 transducer circuit means for applying an alternating-current signal between the diaphragm means 14a,14b and the conductive means 12a,12a', 12b. The diaphragm means 14a,14b are electrically connected and the conductive means 12a,12a', 12b are electrically connected. The circuit means comprises, for example, the secondary winding 16 of a step-up transformer having one terminal connected to diaphragm means 14a,14b and the other terminal connected to the conductive means 12a,12a', 12b. The primary winding 17 of the transformer is connected to, for example, a suitable audio-frequency signal source 18.

Considering now the operation of the FIG. 1 transducer and referring first to the single sounding unit 10a, when there is no audio signal applied, the diaphragm 14a will be subject to equal attractive electrostatic forces on each side and will thus remain in equilibrium at the mid-position. However, when an alternating audio signal is applied, the two metal electrodes 12a,12a' are simultaneously charged with the same amount of electrical charge resulting in an increase of the surface charge of one electret, for example, electret 11a and a decrease of the surface charge of the other electret, for example, electret 11a'. The diaphragm is thus forced to move towards one side. As the audio-signal polarity reverses, the diaphragm is forced to move to the other side. It is well known that such a push-pull operation inherently reduces harmonic distortion to the lowest possible levels.

Considering now the operation of both sounding units 10a,10b, the diaphragms 14a,14b move in the same direction in response to an applied audio signal and move in the opposite direction as the polarity of the audio signal reverses. However, since the trapped air between diaphragms behaves as a stiff medium acoustically, the sounding units 10a, 10b are thus acoustically coupled to each other. Either of the diaphragms 14a,14b, apart from being acted upon by electrostatic forces, is also subjected to acoustic forces which are generated by the vibratory motion of the other diaphragm. Since these forces are additive, the output sound pressure from the transducer is increased. It is clear, therefore, that additional sounding units similar to the sounding units 10a,10b may be stacked with the units 10a,10b and acoustically coupled thereto and electrically connected in a manner similar to units 10a,10b.

Figure 2:
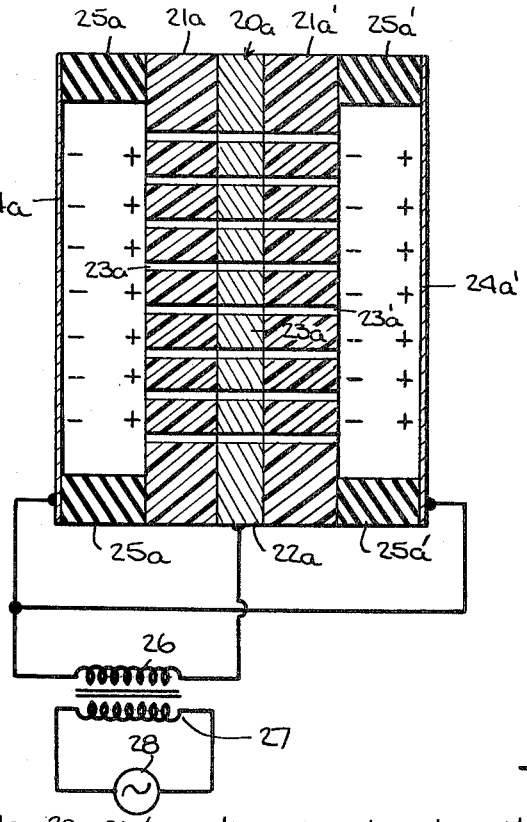
FIG. 2 is a schematic sectional view of another embodiment of a transducer constructed in accordance with the invention.

Referring now to FIG. 2 of the drawings, a transducer preferably comprises a sounding unit 20a including a pair of electrostatically polarized stator electrets 21a,21a'. The electrets 21a,21a' and the conductive means 22a each have apertures 23a,23a' therethrough. The apertures 23a,23a' of the electrets 21a,21a' and the conductive means 22a preferably are substantially aligned. The transducer also includes thin vibratory diaphragm means 24a,24a' each comprising a thin layer of conductive material, means 25a for supporting the first diaphragm means 24a in spaced relation to one of the electrets 21a throughout the dynamic operation of the first diaphragm means 24a, and means 25a' for supporting the second diaphragm means 24a' in spaced relation to the other electret 21a' throughout the dynamic operation of the second diaphragm means 24a'. The electrets 21a,21a' and the conductive means 22a are disposed between the first and second diaphragm means 24a,24a'. The electrets 21a,21a' are polarized to develop electrical charges of opposite polarity on the surfaces of the electrets facing the diaphragm means 24a,24a', as represented schematically in FIG. 2. The first and second diaphragm means 24a,24a' are acoustically coupled.

The electrets 21a,21a', conductive means 22a, diaphragm means 24a,24a' and diaphragm supporting means 25a,25a' may be of similar construction to the corresponding members of the FIG. 1 transducer and accordingly will not be described in detail.

The diaphragm means 24a,24a' are electrically connected, for example, to one terminal of the secondary winding 26 of a step-up transformer and the conductive means 22a is electrically connected, for example, to the other terminal of the secondary winding 26. For example, an audio-signal source 28 is connected to the primary winding 27 of the transformer.

Considering now the operation of the sounding unit 20 represented in FIG. 2, since the polarities of the electrical charges on the surfaces of the electrets 21a,21a' facing the diaphragms 24a,24a' are opposite in sign, the induced surface charges on the two diaphragms are also of opposite polarites. When there is no audio signal applied, each diaphragm 24a,24a' is attracted toward the electrets 21a,21a' to achieve a static equilibrium position. However, when an audio signal is applied, the two diaphragms are simultaneously charged with the same amount of electrical charge, resulting in an increase of surface charge of one electret, for example, electret 21a and a decrease of surface charge of the other electret, for example, electret 21a'. Both diaphragms and thus forced to move towards one side. This can also be considered as a push-pull operation in the sense that one diaphragm is pushed by one electret and the other diaphragm is pulled by the other electret. As the audio signal polarity reverses, both diaphragms are forced to move to the other side. Also, the air trapped between the diaphragms acts as a stiff acoustic medium, and each diaphragm, apart from being acted upon by electrostatic force, is also subject to acoustic forces generated by the vibratory motion of the other diaphragm. These forces are additive and thus the diaphragms are so acoustically coupled as to vibrate in unison throughout the dynamic operation of the transducer.

Figure 3:
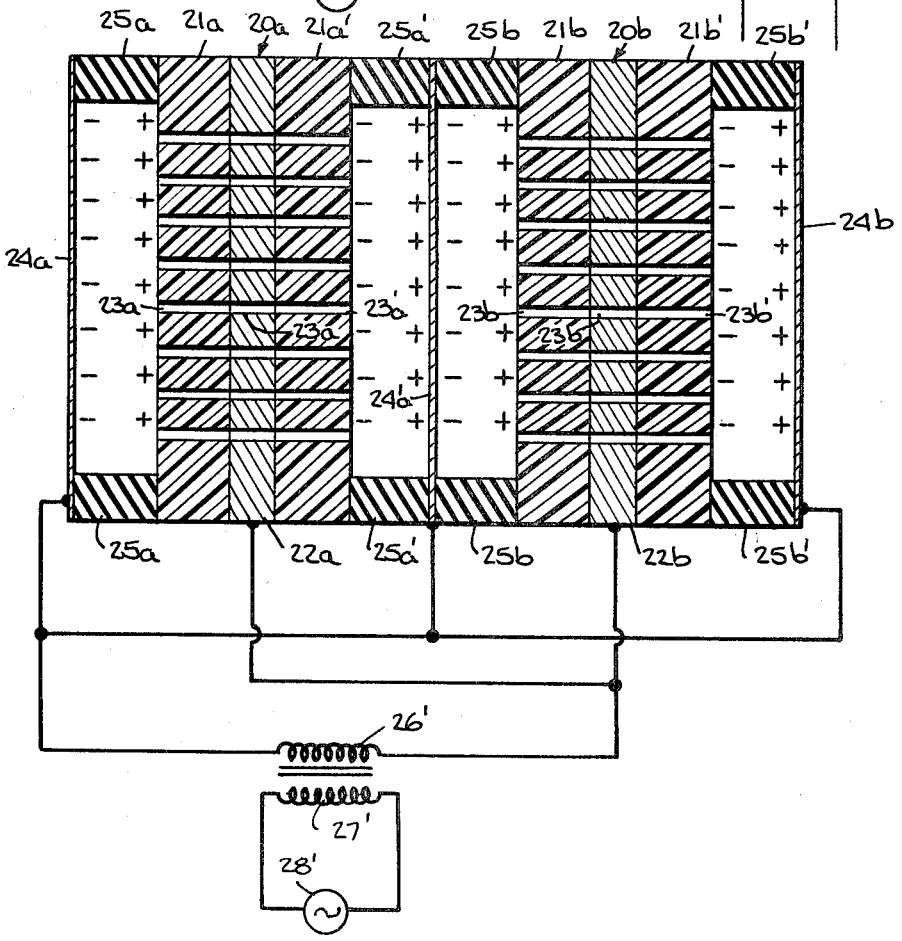
FIG. 3 is a schematic sectional view of another embodiment of a transducer constructed in accordance with the invention.

Referring now to FIG. 3, the transducer there represented preferably includes a sounding unit 20*a* substantially identical with the FIG. 2 sounding unit 20*a* and also preferably includes a second sounding unit 20*b* substantially identical with the sounding unit 20*a* but having a diaphragm means 24*a'* in common therewith. The sounding unit 20*b* includes a second pair of electrostatically polarized stator electrets 21*b*,21*b'* and conductive means 22*b* adjacent the second pair of electrets 21*b*,21*b'*. The second pair of electrets 21*b*,21*b'* and the conductive means 22*b* have apertures 23*b*,23*b'* therethrough. The sounding unit 20*b* includes means 25*b* for supporting the second diaphragm means 24*a'* in spaced relation to electret 21*b* of the second pair of electrets 21*b*,21*b'* throughout the dynamic operation of the second diaphragm means 24*a'*. The sounding unit 20*b* also includes third thin vibratory diaphragm means 24*b* comprising a layer of conductive material and means 25*b'* for supporting the third diaphragm means 24*b* in spaced relation to electret 21*b'* of the second pair of electrets 21*b*,21*b'* throughout the dynamic operation of the third diaphragm means 24*b*.

The second pair of electrets 21*b*,21*b'* and the conductive means 22*b* adjacent thereto are disposed between the second diaphragm means 24*a'* and the third diaphragm means 24*b*. The second pair of electrets 21*b*,21*b'* is polarized to develop electrical charges of opposite polarity on the surfaces of the second pair of electrets 21*b*,21*b'* facing the second and third diaphragm means 24*a'*,24*b*, as represented schematically in FIG. 3. The second pair of electrets 21*b*,21*b'* facing the second and third diaphragm means 24*a'*, 24*b* also is polarized to develop electrical charges of the same polarity as corresponding electrets 21*a*,21*a'* of the first pair develop on the surfaces thereof facing the first and second diaphragm means 24*a*,24*a'* respectively. The first, second and third diaphragm means 24*a*,24*a'*,24*b* are so acoustically coupled through the apertures 23*a*,23*a'*,23*b*,23*b'* as to vibrate in unison throughout the dynamic operation of the transducer.

Circuit means comprising, for example, the secondary winding 26' of a step-up transformer is electrically connected to the sounding units 20*a*, 20*b* for applying an alternating current signal between the diaphragm means 24*a*,24*a'*,24*b* and the conductive means 22*a*, 22*b*. The diaphragm means 24*a*,24*a'*, 24*b* are electrically connected and the conductive means 22*a*, 22*b* are electrically connected. For example, an audio-signal source 28' is connected to the primary winding 27' of the transformer.

Considering now the operation of the FIG. 3 transducer, the sounding unit 20*a* of FIG. 3 operates in the same manner as the sounding unit 20*a* of FIG. 2. The sounding unit 20*b* also operates in the same manner as the sounding unit 20*a* of FIG. 2. However, with the sounding units 20*a*, 20*b* acoustically coupled together and with the trapped air acting as a stiff acoustic medium, any one of the diaphragms 24*a*,24*a'*,24*b*, apart from being acted upon by electrostatic forces, is also subject to acoustic forces which are generated by the vibratory motion of the other diaphragms. Since these forces are additive, the output sound pressure from the transducer is increased. It is clear, therefore, that additional sounding units similar to the sounding units 20*a*,20*b* may be stacked with the units 20*a*, 20*b* and acoustically coupled thereto and electrically connected in a manner similar to units 20*a*,20*b*.

Transducers constructed in accordance with the present invention have many advantages over prior art. For the same diaphragm (sound-radiating) area and applied audio signal voltage, the output sound pressure is many times larger than that of electrostatic transducers based on the prior art. This permits a considerable reduction of diaphragm area to achieve the same amount of sound output as prior electrostatic transducers.

Also, by using sheet electrets having a minimum thickness of 5 mils instead of foil electrets, higher equivalent direct-current bias voltage can be obtained. Thus, high audio-signal voltage can be used without producing objectionable harmonic distortion. Also, since the electrets are stationary, it is thus possible to use different materials to satisfy the requirements of the mechanical properties of the vibratory diaphragms and the requirements of the electrical properties of the electrets.

Further, since a center-tapped transformer is not required, the transformer may be smaller in size, lighter in weight and less expensive to produce.

Additionally, because an active high direct-current voltage supply is not used, high voltage shock hazard, complications in design, and higher cost associated with the high voltage supply and insulation are eliminated.

Also, unlike conventional electrostatic electroacoustic transducers in which the audio-signal voltage is divided between the electrodes, the signal voltage in the transducers according to the present invention is applied between the electrodes and the diaphragms. Therefore, voltage sensitivity is doubled. In otherwords, only half the signal voltage is required to produce the same amount of output sound pressure.

Further, since the electrets are either totally physically shielded (as in the FIGS. 2 and 3 transducers) or partially physically shielded (as in the FIG. 1 transducer) by the vibratory diaphragms from outside environment (humidity, dust, ions, etc.), the decay of surface charge of electrets usually associated with humidity or ions present in the atmosphere is thus eliminated or minimized. It is well known that the surface charges of electrets decay more rapidly when the electrets are exposed to humidity or to ions present in the atmosphere.

Using 20 mil Teflon-FEP electrets, 0.25 mil Mylar film as vibratory diaphragms, and 20 mil cardboard frames as spacers between electrets and vibratory diaphragms, electret headphones in accordance with the FIG. 1 and FIG. 3 embodiments have a flat frequency response (within $\pm 3$ decibels) from 20 Hertz to 20 Kilohertz. With 100 alternating-current volts as input signal into the headphones, the output sound pressure level was about 105 decibels. At 90 decibels or lower output sound pressure level, total harmonic distortion was less than one percent over the entire audio frequency band from 30 Hertz to 20 Kilohertz. The transducer also had good square wave response at, for example, 200 Hertz and 95 decibels output sound pressure level, indicating it is capable of superior transient response.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

We claim:

1. An electromechanical push-pull transducer comprising a first pair of electrostatically polarized stator electrets, conductive means adjacent each of said electrets, said electrets and said conductive means each having apertures therethrough, a first thin vibratory internally non-polarized diaphragm comprising a layer of conductive material, means for supporting said diaphragm between said electrets in spaced relation thereto throughout the dynamic operation of said diaphragm, said electrets being polarized to develop electrical charges of opposite polarity on the surfaces of said electrets facing said diaphragm, a second pair of electrostatically polarized stator electrets, one of said second pair of electrets being adjacent one of said conductive means, conductive means adjacent the other electret of said second pair, said second pair of electrets and said conductive means adjacent thereto each having apertures therethrough, a second thin vibratory internally non-polarized diaphragm comprising a layer of conductive material, means for supporting said second diaphragm between said second pair of electrets in spaced relation thereto throughout the dynamic operation of said second diaphragm, said second pair of electrets being polarized to develop electrical charges of opposite polarity on the surfaces of said second pair of electrets facing said second diaphragm, said second pair of electrets also being polarized to develop electrical charges of the same polarity as corresponding electrets of said first pair develop on said surfaces thereof facing said first diaphragm, said first and second diaphragms being so acoustically coupled as to vibrate in unison throughout the dynamic operation of the transducer, and circuit means for applying an alternating current signal between said diaphragms and said conductive means, said diaphragms being electrically connected and said conductive means being electrically connected.

2. A transducer in accordance with claim 1 in which said apertures of said electrets and said conductive means adjacent thereto are substantially aligned.

3. A transducer in accordance with claim 1 suitable for use as a headphone and in which each diaphragm covers uniformly substantially the entire audio frequency range.

4. An electromechanical push-pull transducer comprising a pair of electrostatically polarized stator electrets, conductive means adjacent said electrets, said electrets and said conductive means each having apertures therethrough, first and second thin vibratory internally non-polarized diaphragms each comprising a layer of conductive material, means for supporting said first diaphragm in spaced relation to one of said electrets throughout the dynamic operation of said first diaphragm, said first diaphragm being an external electrostatic member of said transducer, and means for supporting said second diaphragm in spaced relation to the other of said electrets throughout the dynamic operation of said second diaphragm, said electrets and said conductive means being disposed between said first and second diaphragms, said electrets being polarized to develop electrical charges of opposite polarity on the surfaces of said electrets facing said diaphragms, said first and second diaphragms being so acoustically coupled as to vibrate in unison throughout the dynamic operation of the transducer, a second pair of electrostatically polarized stator electrets, conductive means adjacent said second pair of electrets, said second pair of electrets and said conductive means adjacent thereto each having apertures therethrough, means for supporting said second diaphragm in spaced relation to one of said second pair of electrets throughout the dynamic operation of said second diaphragm, a third thin vibratory internally non-polarized diaphragm comprising a layer of conductive material, and means for supporting said third diaphragm in spaced relation to the other of said second pair of electrets throughout the dynamic operation of said third diaphragm, said second pair of electrets and said conductive means adjacent thereto being disposed between said second and third diaphragms, said second pair of electrets being polarized to develop electrical charges of opposite polarity on the surfaces of said second pair of electrets facing said second and third diaphragms, said second pair of electrets facing said second and third diaphragms also being polarized to develop electrical charges of the same polarity as corresponding electrets of said first pair develop on said surfaces thereof facing said first and second diaphragms, respectively, said first, second and third diaphragms being so acoustically coupled as to vibrate in unison throughout the dynamic operation of the transducer.

5. A transducer in accordance with claim 3 suitable for use as a heaphone and in which each diaphragm covers uniformly substantially the entire audio frequency range.

6. A transducer in accordance with claim 3 in which said third diaphragm is an external electrostatic member of said transducer.

7. A transducer in accordance with claim 4 and circuit means coupled thereto for applying an alternating current signal between said diaphragms and said conductive means, said diaphragms being electrically connected and said conductive means being electrically connected.

* * * * *